US010646894B2

(12) United States Patent
Kuo et al.

(10) Patent No.: US 10,646,894 B2
(45) Date of Patent: May 12, 2020

(54) SQUEEGEE APPARATUS AND METHODS OF USE THEREOF

(71) Applicant: GENERAL ELECTRIC COMPANY, Schenectady, NY (US)

(72) Inventors: Pei-Hsin Kuo, Alplaus, NY (US); Weston Blaine Griffin, Niskayuna, NY (US); Venkat Subramaniam Venkataramani, Clifton Park, NY (US); Hrishikesh Keshavan, Watervliet, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 183 days.

(21) Appl. No.: 15/199,180

(22) Filed: Jun. 30, 2016

(65) Prior Publication Data

US 2018/0001336 A1 Jan. 4, 2018

(51) Int. Cl.
*B05C 11/04* (2006.01)
*B22F 5/00* (2006.01)
(Continued)

(52) U.S. Cl.
CPC ..... *B05C 11/045* (2013.01); *B05C 11/023* (2013.01); *B05C 17/002* (2013.01);
(Continued)

(58) Field of Classification Search
None
See application file for complete search history.

(56) References Cited

U.S. PATENT DOCUMENTS 4,649,858 A 3/1987 Sakai et al.
5,644,394 A 7/1997 Owens
(Continued)

FOREIGN PATENT DOCUMENTS

EP 1172460 A2 1/2002
WO 2015073196 A1 5/2015
WO 2015082818 A1 6/2015

OTHER PUBLICATIONS

K.J. Pallos, "Gas Turbine Repair Technology," GE Power Systems, GER-3975B, pp. 1-26.
(Continued)

*Primary Examiner* — Jethro M. Pence
(74) *Attorney, Agent, or Firm* — Christopher R. Carroll; The Small Patent Law Group LLC

(57) ABSTRACT

The present invention is directed to a squeegee apparatus which includes a main housing including an inlet end and an outlet end, the outlet end including an extrusion face and a protruding lip member, the inlet end including an inlet opening and the extrusion face including at least one outlet opening, wherein the inlet opening and the at least one outlet opening are in fluid communication with each other within the main housing. The present invention is also directed to a method for repairing a thermal barrier coating with a squeegee apparatus including supplying a repair composition into the inlet opening of the squeegee apparatus and depositing the repair composition from the at least one outlet opening onto the damaged region and concurrently traversing the squeegee apparatus over the damaged region while contacting a thermal barrier coating adjacent to the damaged region with the lip member.

20 Claims, 8 Drawing Sheets

(51) Int. Cl.

| | |
|---|---|
| ***B22F 7/08*** | (2006.01) |
| ***B05C 17/00*** | (2006.01) |
| ***B05C 11/02*** | (2006.01) |
| *B05C 5/02* | (2006.01) |

(52) U.S. Cl.
CPC ..... *B22F 5/009* (2013.01); *B22F 7/08* (2013.01); *B05C 5/027* (2013.01); *B05C 11/04* (2013.01)

(56) References Cited

U.S. PATENT DOCUMENTS

| | | | |
|---|---|---|---|
| 5,723,078 | A | 3/1998 | Nagaraj et al. |
| 5,759,932 | A | 6/1998 | Sangeeta et al. |
| 5,902,647 | A | 5/1999 | Venkataramani et al. |
| 5,985,368 | A | 11/1999 | Sangeeta et al. |
| 6,042,880 | A | 3/2000 | Rigney et al. |
| 6,074,706 | A | 6/2000 | Beverley et al. |
| 6,235,352 | B1 | 5/2001 | Leverant et al. |
| 6,335,078 | B2 | 1/2002 | Venkataramani et al. |
| 6,378,159 | B1 | 4/2002 | Garrison et al. |
| 6,413,578 | B1 | 7/2002 | Stowell et al. |
| 6,497,758 | B1 | 12/2002 | Hasz et al. |
| 6,605,160 | B2 | 8/2003 | Hoskin |
| 6,827,969 | B1 | 12/2004 | Skoog et al. |
| 6,875,464 | B2 | 4/2005 | Ruud et al. |
| 6,881,439 | B2 | 4/2005 | Graham et al. |
| 6,890,587 | B2 | 5/2005 | Khan et al. |
| 6,919,121 | B2 | 7/2005 | Stowell et al. |
| 7,008,522 | B2 | 3/2006 | Boucard et al. |
| 7,029,721 | B2 | 4/2006 | Hasz et al. |
| 7,093,993 | B2 | 8/2006 | Skoog et al. |
| 7,476,703 | B2 | 1/2009 | Ruud et al. |
| 7,509,735 | B2 | 3/2009 | Philip et al. |
| 7,588,797 | B2 | 9/2009 | Skoog et al. |
| 7,611,781 | B1 | 11/2009 | Kokubo et al. |
| 7,829,196 | B2 | 11/2010 | Kokubo et al. |
| 7,842,335 | B2 | 11/2010 | Skoog et al. |
| 8,221,825 | B2 | 7/2012 | Reitz et al. |
| 8,400,501 | B2 | 3/2013 | Heyworth et al. |
| 8,563,080 | B2 | 10/2013 | Hopkins |
| 8,597,724 | B2 | 12/2013 | Bunting et al. |
| 9,085,053 | B2 | 7/2015 | Tholen et al. |
| 2003/0024430 | A1 | 2/2003 | Hasz et al. |
| 2003/0101587 | A1 | 6/2003 | Rigney et al. |
| 2005/0129868 | A1 | 6/2005 | Philip et al. |
| 2007/0202269 | A1 | 8/2007 | Potter et al. |
| 2008/0020215 | A1* | 1/2008 | Nakamura ..... B22F 3/16 428/457 |
| 2009/0070955 | A1* | 3/2009 | Hollis ..... A47L 7/0009 15/415.1 |
| 2009/0074576 | A1 | 3/2009 | Brostmeyer |
| 2009/0297701 | A1 | 12/2009 | Jabado et al. |
| 2010/0237134 | A1 | 9/2010 | Bucci et al. |
| 2011/0206533 | A1 | 8/2011 | Lee et al. |
| 2011/0286859 | A1* | 11/2011 | Ortiz ..... F04B 49/002 417/20 |
| 2014/0259589 | A1 | 9/2014 | Xu et al. |
| 2014/0315029 | A1 | 10/2014 | Roberts, III et al. |
| 2015/0174837 | A1 | 6/2015 | Kolvick et al. |
| 2015/0175486 | A1 | 6/2015 | Roberts et al. |

OTHER PUBLICATIONS

C. Rinaldi, et al, "Epitaxial Repair and In Situ Damage Assessment for Turbine Blades," Journal of Power and Energy, Mar. 1, 2005, pp. 93-99, vol. 219, Issue 2.

* cited by examiner

SQUEEGEE APPARATUS AND METHODS OF USE THEREOF

FIELD OF THE INVENTION

The present invention is directed to a squeegee apparatus useful for dispensing and applying a coating repair composition. The present invention is also directed to a method of use of the squeegee apparatus disclosed herein.

BACKGROUND OF THE INVENTION

Higher operating temperatures of gas turbine engines are continually being sought in order to increase the efficiency of the engines. However, as operating temperatures increase, the high temperature durability of the components of the engine must correspondingly increase. Significant advances in high temperature capabilities have been achieved through the formulation of nickel, cobalt and iron based superalloys. These superalloys can be designed to withstand temperatures in the range of about 1000 to about 1100° C. or higher. Nonetheless, when used to form components of the turbine, such as combustor liners, augmentor hardware, shrouds and high and low-pressure nozzles and blades, the superalloys alone could be susceptible to damage by oxidation and hot corrosion attack. Accordingly, these components are typically protected by an environmental and/or a thermal barrier coating ("TBC"). In general, TBCs can be used in conjunction with the superalloys in order to reduce the cooling air requirements associated with a given turbine. Ceramic materials, such as yttrium-stabilized zirconia (YSZ), are widely used as a TBC or topcoat of TBC systems. These materials are employed because, for example, they can be readily deposited by plasma-spraying and physical vapor deposition (PVD) techniques, and they also generally exhibit desirable thermal characteristics. In general, these TBCs can be utilized in conjunction with the superalloys in order to reduce the cooling air requirements associated with a given turbine.

In order to be effective, TBCs need to possess low thermal conductivity, strongly adhere to the component and remain adhered through many heating and cooling cycles. The latter requirement is particularly demanding due to the different coefficients of thermal expansion between the ceramic materials and the superalloy substrates that they protect. To promote adhesion and extend the service life of a TBC, an oxidation-resistant bond coating typically takes the form of a diffusion aluminide coating or an overlay coating, such as MCrAlX where M is iron, cobalt and/or nickel and X is yttrium or another rare earth element. During the deposition of a ceramic TBC and subsequent exposures to high temperatures, such as during engine operation, these bond coats form a tightly adherent alumina ($Al_2O_3$) layer or scale that adheres the TBC to the bond coat.

The service life of a TBC is typically limited by a spallation event brought on by, for example, thermal fatigue. Accordingly, a significant challenge has been to obtain a more adherent ceramic layer that is less susceptible to spalling when subjected to thermal cycling. Though significant advances have been made, there is the inevitable requirement to repair components whose thermal barrier coatings have spalled. Though spallation typically occurs in localized regions or patches, a conventional repair method has been to completely remove the TBC after removing the affected component from the turbine or other area, restore or repair the bond coat as necessary and recoat the engine component. Techniques for removing TBCs include grit blasting or chemically stripping with an alkaline solution at high temperatures and pressures. However, grit blasting is a slow, labor-intensive process and can erode the surface beneath the coating. The use of an alkaline solution to remove a TBC also is less than ideal because the process typically requires the use of an autoclave operating at high temperatures and pressures. Consequently, some conventional repair methods are labor intensive and expensive, and can be difficult to perform on components with complex geometries, such as airfoils and shrouds. As an alternative, U.S. Pat. No. 5,723,078 to Nagaraj et al. teach selectively repairing a spalled region of a TBC by texturing the exposed surface of the bond coat, and then depositing a ceramic material on the textured surface by plasma spraying. While avoiding the necessity to strip the entire TBC from a component, the repair method taught by Nagaraj et al. requires removal of the component in order to deposit the ceramic material.

In the case of large power generation turbines, completely halting power generation for an extended period of time in order to remove components whose TBCs have suffered only localized spallation is not economically desirable.

U.S. Pat. No. 7,476,703 discloses an in-situ method and composition for repairing a thermal barrier coating, which is based on a silicone resin system. U.S. Pat. No. 6,413,578 discloses an in-situ method for repairing thermal barrier coating with a ceramic paste. In situ methods of repairing a damaged component, such as TBC coating, are also disclosed in U.S. Pat. Nos. 7,509,735, 8,563,080, and U.S. Patent Application Publication No. 2015/0174837. A repair composition is disclosed in U.S. Pat. No. 6,875,464. A commercially available repair composition, AIM-MRO SR Resin Patch, may also be used for TBC repair.

However, there remains a need for an apparatus that would allow for effective application of repair composition to damaged regions of TBC. Such effective application includes application of a repair composition not only to flat surfaces but also to non-planar curved surfaces, which also suffer from TBC damage in turbine assemblies. Accordingly, the present invention seeks to provide a novel squeegee apparatus designed for dispensing and effectively applying a repair composition and methods of use thereof.

SUMMARY OF THE INVENTION

One object of the present invention is to provide a squeegee apparatus useful for dispensing and applying a coating repair composition. Another object of the present invention is to provide method of use of the squeegee apparatus disclosed herein.

Accordingly, in one embodiment, the invention is directed to a squeegee apparatus which includes a main housing including an inlet end and an outlet end, the outlet end including an extrusion face and a protruding lip member, wherein the lip member is flexible and elongated, the inlet end including an inlet opening, and the extrusion face including at least one outlet opening, wherein the inlet opening and the at least one outlet opening are in fluid communication with each other within the main housing.

In another embodiment, the invention is directed to a method for repairing a thermal barrier coating with a squeegee apparatus, wherein the thermal barrier coating is located on a component and wherein the thermal barrier coating has a damaged region, wherein the squeegee apparatus includes a main housing including an inlet end and an outlet end, the outlet end including an extrusion face and a protruding lip member, wherein the lip member is flexible and elongated, the inlet end including an inlet opening, and the extrusion face including at least one outlet opening, and wherein the inlet opening and the at least one outlet opening are in fluid communication with each other within the main housing. In one embodiment, the method includes supplying a repair composition into the inlet opening, and depositing the repair composition from the at least one outlet opening onto the damaged region and concurrently traversing the squeegee apparatus over the damaged region while contacting a thermal barrier coating adjacent to the damaged region with the lip member, wherein the extrusion face is situated in front of the lip member relative to a direction of the traversing of the squeegee apparatus over the damaged region, whereby the repair composition is deposited onto the damaged region to form a patch.

The squeegee apparatus disclosed herein is advantageous because it can deliver repair composition at a desired flow rate, which may be constant or variable. Additionally, the disclosed squeegee apparatus has a flexible lip member which allows the squeegee apparatus to adopt to various curvatures of the coating being repaired, which ensures that the repair composition is delivered against the surface and covers the damaged region. Furthermore, the squeegee apparatus described herein may be easily 3D printed using additive manufacturing methods. These and additional features provided by the embodiments discussed herein will be more fully understood in view of the following detailed description, in conjunction with the drawings.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

In the following specification and the claims which follow, reference will be made to a number of terms, which shall be defined to have the following meanings.

The singular forms "a", "an", and "the" include plural referents unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about", is not to be limited to the precise value specified. In some instances, the approximating language may correspond to the precision of an instrument for measuring the value.

As used herein, the term "damaged region" refers to any deposit or damage on a surface of an internal component of a turbine assembly. Such damaged region may be a result of dust accumulation, coating spallation, oxidation, corrosion, erosion, impact, wear, foreign object damage, or cracking.

As used herein, the term "thermal barrier coating" or "TBC" refers to known in the art ceramic materials systems applied to metallic and ceramic substrates, such as on gas turbine or aero-engine parts, operating at elevated temperatures, as a form of heat management. The term "TBC", as used herein, includes environment barrier coating.

As used herein, the term "repair composition" refers to a composition that may be used to repair the damaged region of a TBC.

In one embodiment, the invention is directed to a squeegee apparatus which includes a main housing including an inlet end and an outlet end, the outlet end including an extrusion face and a protruding lip member, wherein the lip member is flexible and elongated, the inlet end including an inlet opening, and the extrusion face including at least one outlet opening, wherein the inlet opening and the at least one outlet opening are in fluid communication with each other within the main housing.

In one embodiment, at least one outlet opening is a plurality of outlet openings. In another embodiment, the extrusion face is elongated and positioned lengthwise adjacent to the lip member. In one embodiment, the extrusion face is elongated and positioned lengthwise adjacent to the lip member, and wherein the at least one outlet opening is a plurality of outlet openings.

In another embodiment, the main housing further includes an internal chamber, wherein the internal camber is in fluid communication with the inlet opening, and wherein the internal chamber is in fluid communication with the plurality of outlet openings via a plurality of flow channels located within the main housing.

Figure 1:
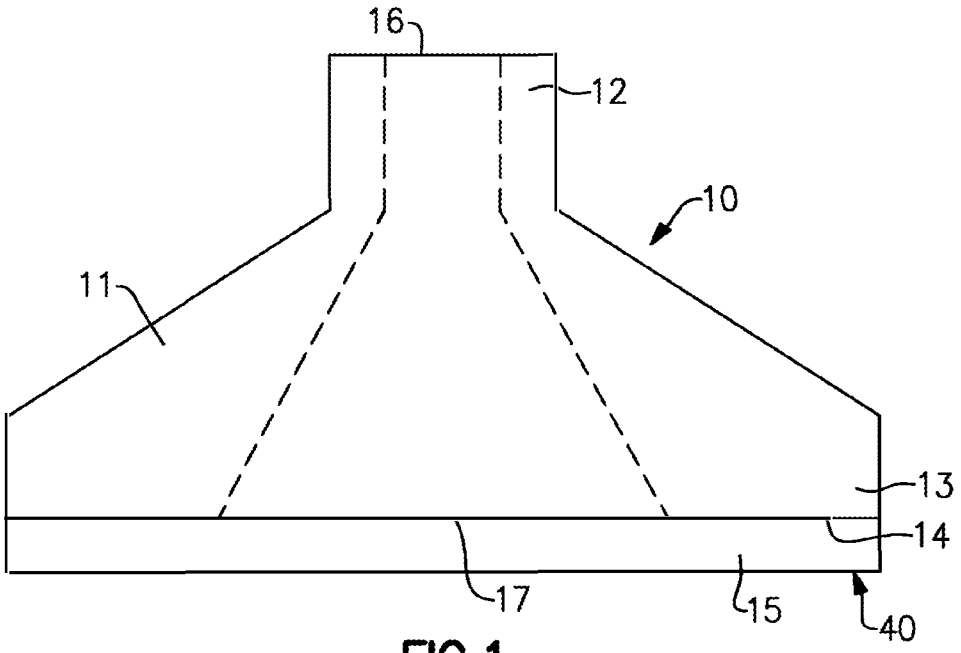
FIG. 1 provides a cross-sectional frontal view of an embodiment of a squeegee apparatus.

With respect to the lip member, in addition to removing the excess repair composition, the compliance (i.e., flexibility) of the lip member allows for less accurate positioning of the squeegee apparatus from the surface. When considering a straight or a curved surface, if the lip member is rigid, the positioning of the squeegee apparatus has to be extremely accurate to ensure that the repair composition is deposited in the damaged region flush with the original TBC surface (surface profile tracking) and also to ensure that excess repair composition above and around the damaged region is removed. Because the lip member of the present invention is flexible, the positioning of the squeegee apparatus does not have to be extremely accurate to ensure that the repair composition is deposited in the damaged region flush with the original TBC surface. The flexibility of the lip member also allows for removal of excess repair composition from above and around the damaged region. Furthermore, when considering a surface like that of a combustion liner, which is curved in two orthogonal directions, if the curvature is slight, the compliance of the lip member can be used to accommodate such curvature. In one embodiment, the edge of the lip member (i.e, the outer edge of the lip member which comes into contact with the TBC during performance of the methods of the invention, see edge 40 in FIGS. 7 and 8) is straight (e.g., see straight edge 40 in FIG. 1). In another embodiment, the edge of the lip member is curved to precisely or approximately match the curvature of the TBC surface. Having a curved edge of the lip member is advantageous when repairing surfaces that have more than slight curvature. Generally, for the purposes of this invention, the curvature of the TBC surface is slight if the radius of the curved TBC surface is 5 or more times greater than the length of the lip member.

Furthermore, the ease of repair is improved if the length of the lip member is greater than the maximal width of the damaged region which is being repaired. Thus, in one embodiment, the length of the lip member is greater than the maximal width of the damaged region. Thus, if the damaged region has a circular shape, the lip member will be in contact with the surface of the TBC on either side of the damaged region. The repair is also possible when the lip member is shorter than the maximal width of the damaged region. Thus, in another embodiment, the length of the lip member is less than the maximal width of the damaged region.

In another embodiment, if the damaged region has a shape that is other than circular, the length of the lip member is long enough to allow for the lip member to be in contact with surface of the TBC on either side of the damaged region as the lip member traverses over the damaged region. For example, if the damaged region has a long and narrow shape, the lip member may be traversed perpendicularly to the damaged area, with sides of the lip member in contact with the surface of the TBC as the lip member traverses over the damaged region.

In one embodiment, the inlet end is mounted to an adaptor, the adaptor further mounted to an outlet end of a conduit, wherein the adaptor includes a sensor operable to detect presence of a repair composition in the adaptor. In another embodiment, the conduit further includes an inlet end and wherein the inlet end of the conduit is mounted to a repair composition storage apparatus, wherein the repair composition storage apparatus is operable to deliver the repair composition to the inlet opening via the conduit and the adaptor.

In another embodiment, the invention is directed to a method for repairing a thermal barrier coating with a squeegee apparatus, wherein the thermal barrier coating is located on a component and wherein the thermal barrier coating has a damaged region, wherein the squeegee apparatus includes a main housing including an inlet end and an outlet end, the outlet end including an extrusion face and a protruding lip member, wherein the lip member is flexible and elongated, the inlet end including an inlet opening, and the extrusion face including at least one outlet opening, and wherein the inlet opening and the at least one outlet opening are in fluid communication with each other within the main housing. In one embodiment, the method includes supplying a repair composition into the inlet opening, and depositing the repair composition from the at least one outlet opening on the extrusion face onto the damaged region and concurrently traversing the squeegee apparatus over the damaged region while contacting a thermal barrier coating adjacent to the damaged region with the lip member, wherein the extrusion face is situated in front of the lip member relative to a direction of the traversing of the squeegee apparatus over the damaged region, whereby the repair composition is deposited onto the damaged region to form a patch.

In one embodiment, the method further includes, subsequent to the depositing of the repair composition, traversing the squeegee apparatus over the patch while contacting the patch with the lip member. In another embodiment, the method further includes heat treating the patch at a temperature of from about 900° C. to about 1400° C. Heat treating cures the patch and such heat treatment could take place while the turbine is run under normal operating conditions.

The squeegee apparatus used in the methods described herein could be any embodiment of the squeegee apparatus described herein.

FIGS. 1-5 depict various embodiments of a squeegee apparatus 10 which includes a main housing 11 including an inlet end 12 and an outlet end 13, the outlet end including an extrusion face 14 and a protruding lip member 15, wherein the lip member 15 is flexible and elongated, the inlet end 12 including an inlet opening 16 and the extrusion face 14 including at least one outlet opening 17, wherein the inlet opening 16 and the at least one outlet opening 17 are in fluid communication with each other within the main housing 11.

Figure 2:
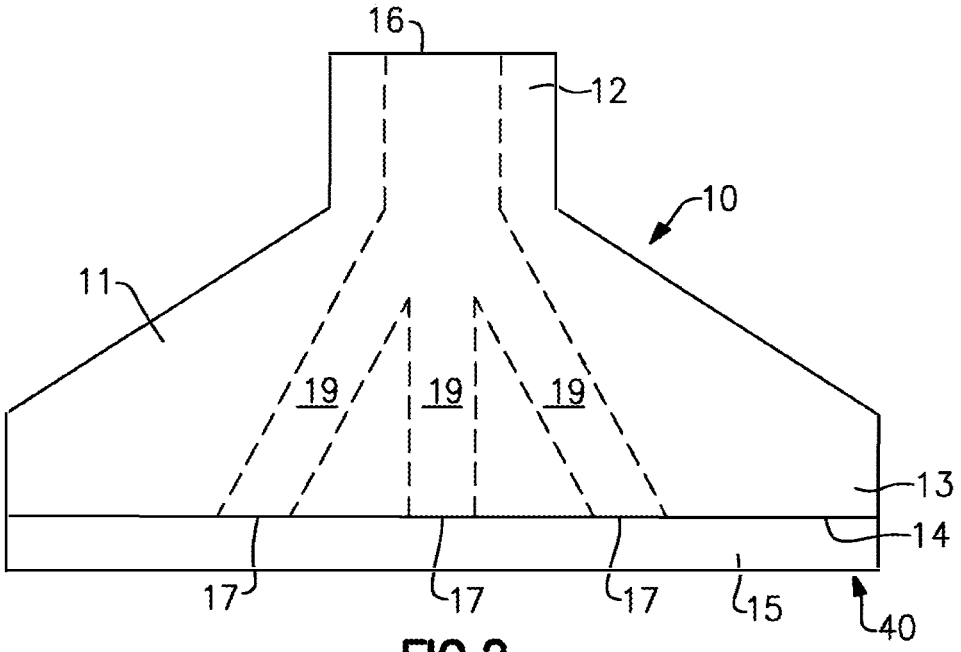
FIG. 2 provides a cross-sectional frontal view of an embodiment of a squeegee apparatus.
Figure 3:
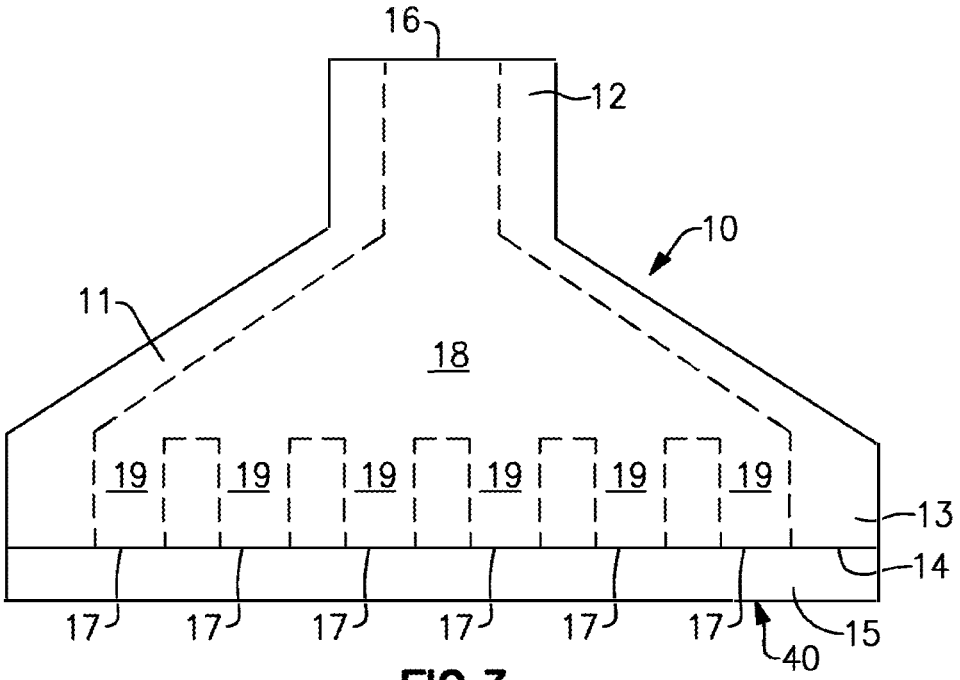
FIG. 3 provides a cross-sectional frontal view of an embodiment of a squeegee apparatus.
Figure 4:
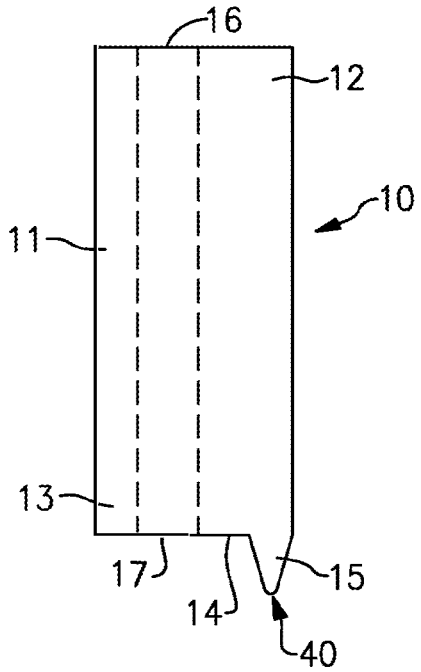
FIG. 4 provides a cross-sectional lateral view of an embodiment of a squeegee apparatus.
Figure 5:
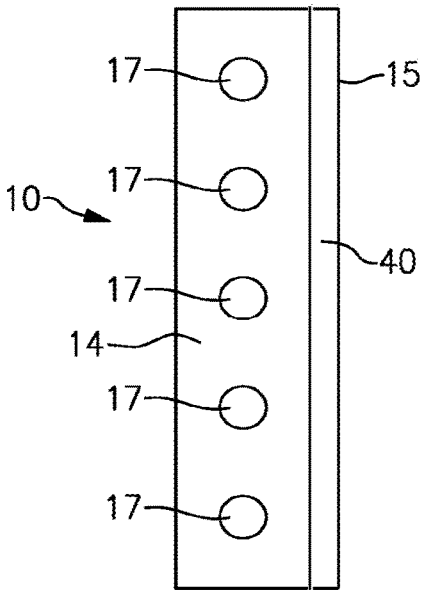
FIG. 5 provides a bottom view of an embodiment of a squeegee apparatus.

In one embodiment, the at least one outlet opening 17 is a plurality of outlet openings 17, as shown in FIGS. 2, 3, and 5. In another embodiment, the extrusion face 14 is elongated and positioned lengthwise adjacent to the lip member 15, for example, as shown in FIG. 5. In one embodiment, the extrusion face 14 is elongated and positioned lengthwise adjacent to the lip member 15, and wherein the at least one outlet opening 17 is a plurality of outlet openings, for example, as shown in FIGS. 2, 3, and 5.

In another embodiment, the main housing 11 further includes an internal chamber 18, wherein the internal chamber 18 is in fluid communication with the inlet opening 16, and wherein the internal chamber 18 is in fluid communication with the plurality of outlet openings 17 via a plurality of flow channels 19 located within the main housing 11, for example, as shown in FIG. 3. In another embodiment, there is no internal chamber 18 and the inlet opening 16 is in direct fluid communication with the plurality of outlet openings 17 via a plurality of flow channels 19, for example, as shown in FIG. 2.

Figure 6:
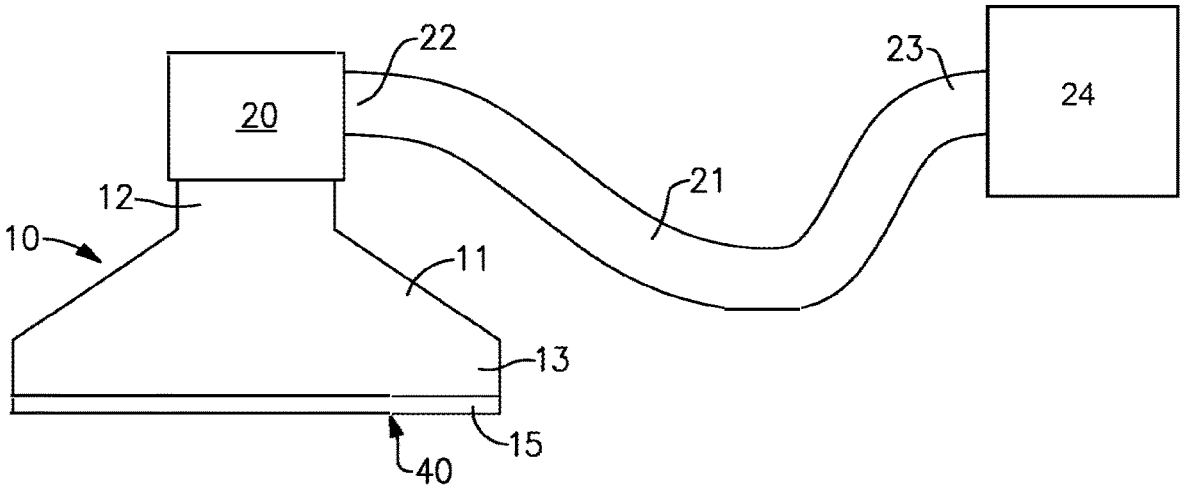
FIG. 6 provides an idealized view of an embodiment of a squeegee apparatus.

In one embodiment, as shown in FIG. 6, the inlet end 13 is mounted to an adaptor 20, the adaptor 20 further mounted to an outlet end of a conduit 22, wherein the adaptor 20 includes a sensor operable to detect presence of a repair composition in the adaptor 20. In another embodiment, the conduit 21 further includes an inlet end 23 and wherein the inlet end 23 of the conduit 21 is mounted to a repair composition storage apparatus 24, wherein the repair composition storage apparatus 24 is operable to deliver the repair composition to the inlet opening 12 via the conduit 21 and the adaptor 20.

Figure 7:
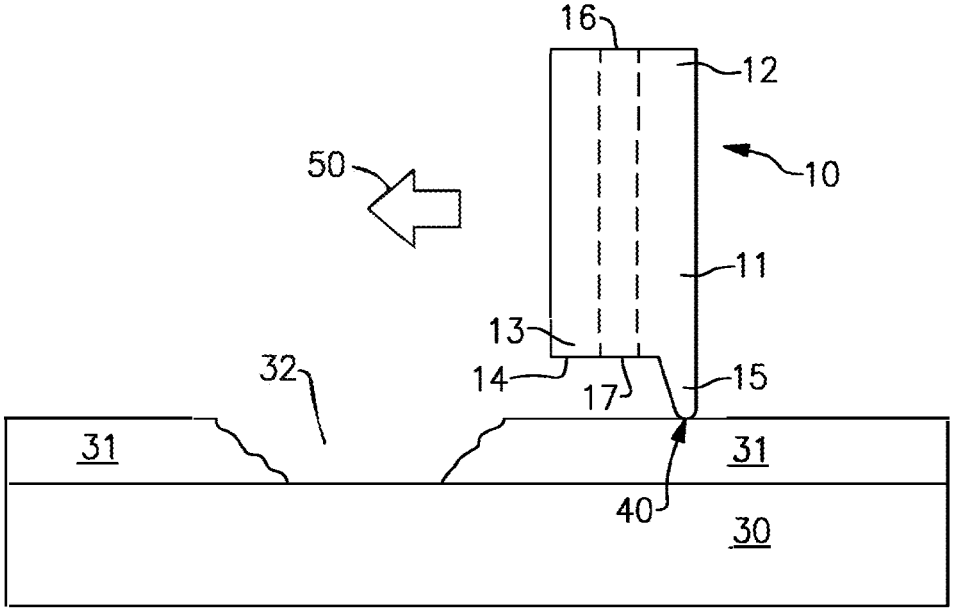
FIG. 7 provides an idealized cross-sectional view of a method of use of a squeegee apparatus.
Figure 8:
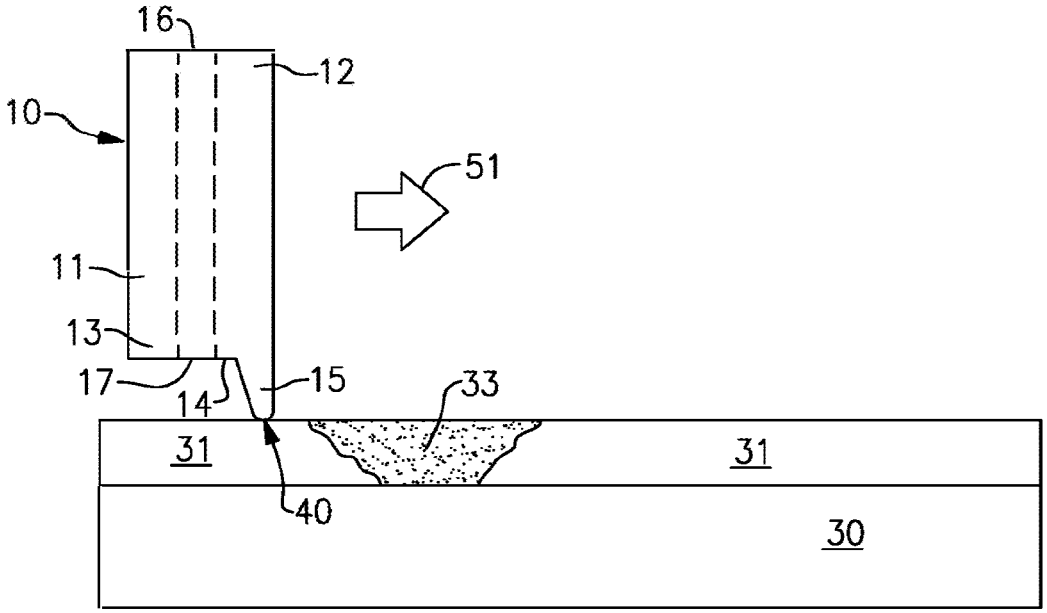
FIG. 8 provides an idealized cross-sectional view of a method of use of a squeegee apparatus.
Figure 9:
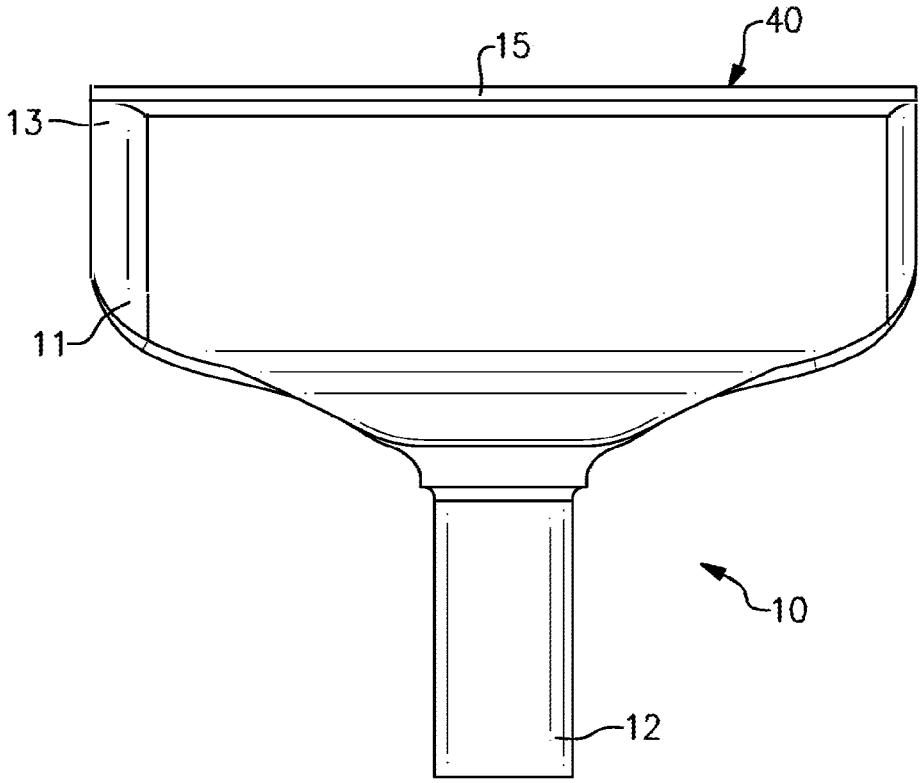
FIG. 9 provides a frontal view of an embodiment of a squeegee apparatus.
Figure 10:
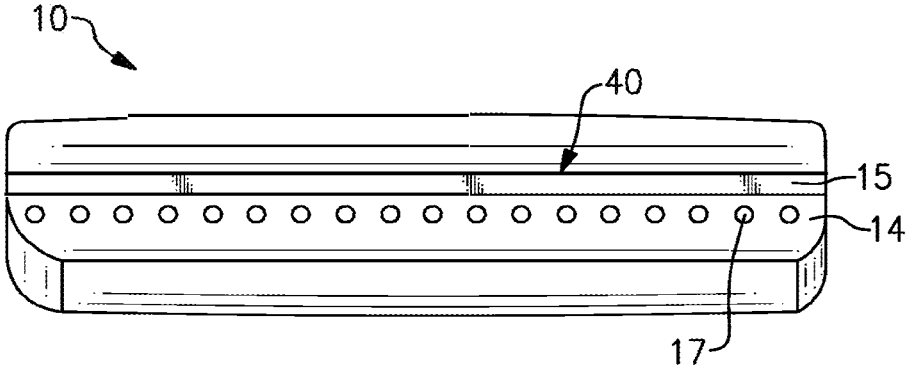
FIG. 10 provides a bottom view of an embodiment of a squeegee apparatus.
Figure 11:
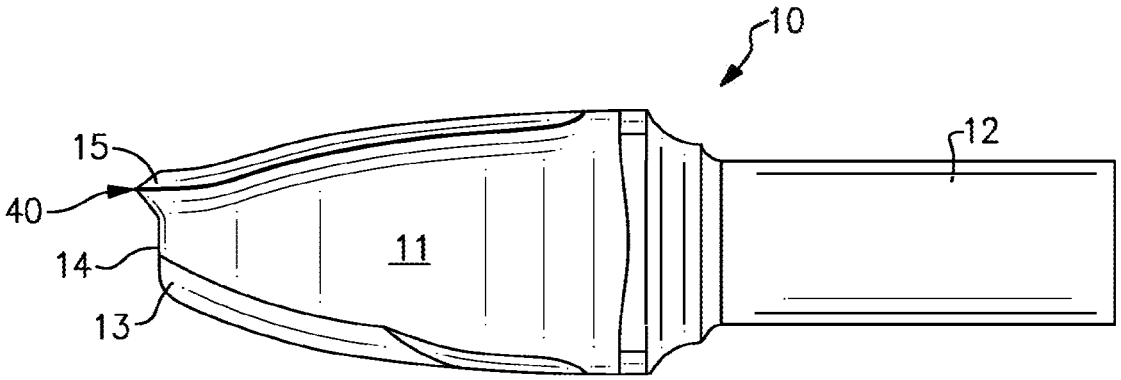
FIG. 11 provides a lateral view of an embodiment of a squeegee apparatus.
Figure 12A:
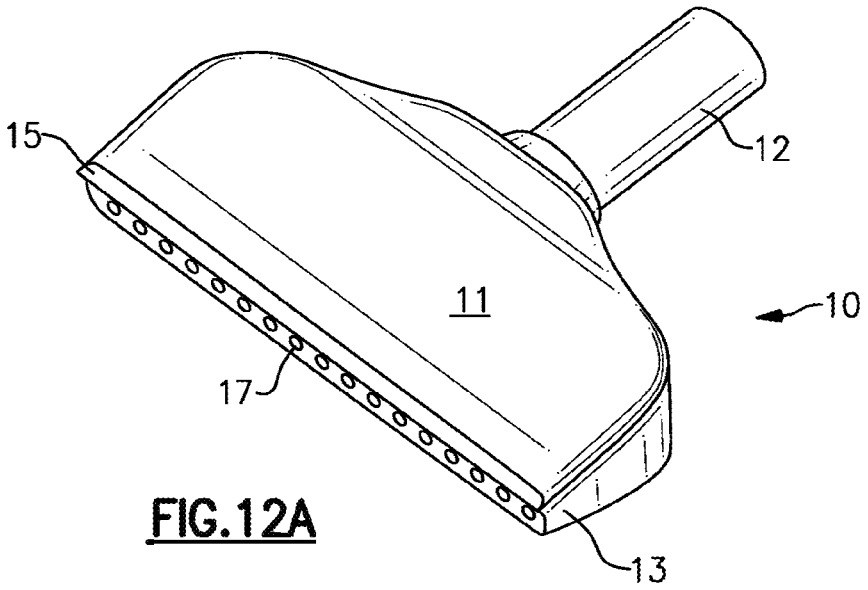
FIGS. 12A and 12B provide isometric views of an embodiment of a squeegee apparatus.
Figure 12B:
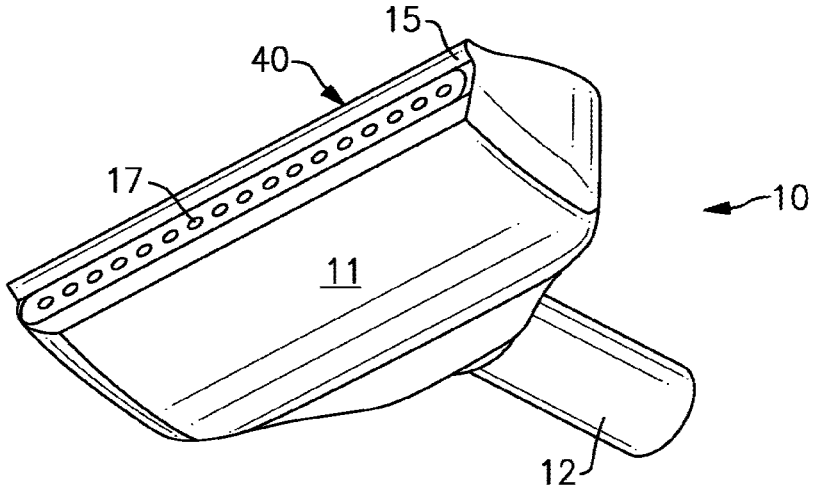
Figure 13:
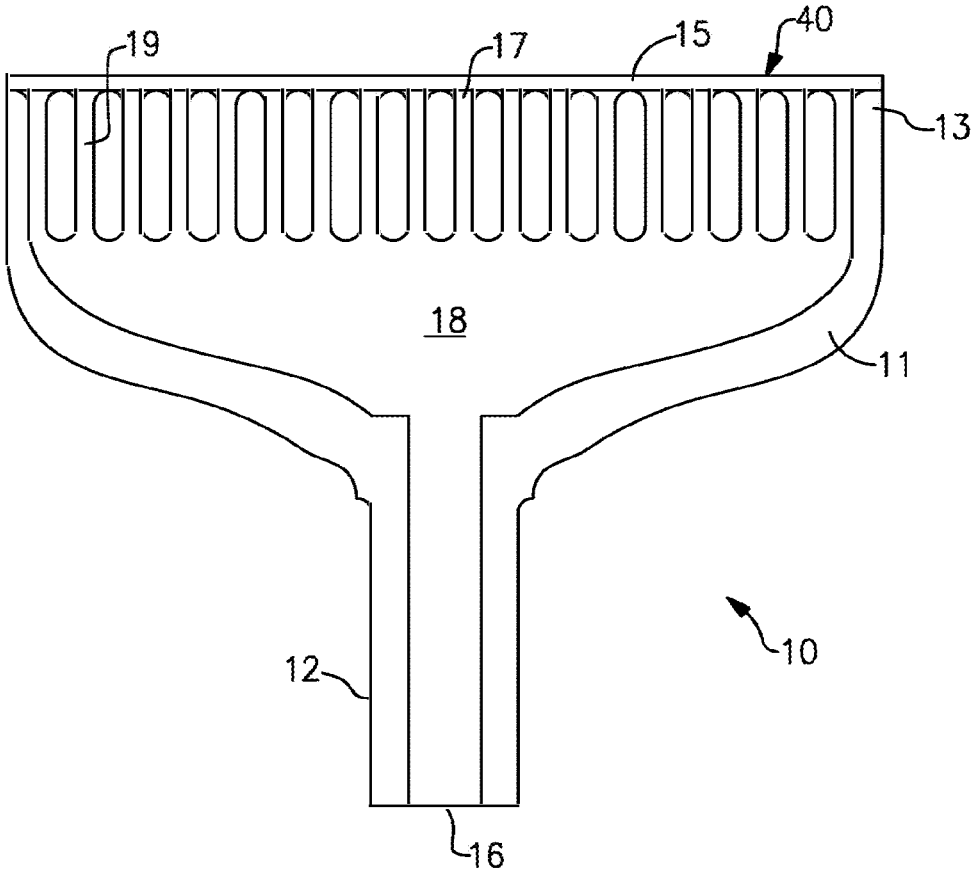
FIG. 13 provides a cross-sectional frontal view of an embodiment of a squeegee apparatus.

Embodiments of methods of the invention are shown in FIGS. 7 and 8. Thus, in one embodiment, the invention is directed to a method for repairing a thermal barrier coating 31 with a squeegee apparatus 10, wherein the thermal barrier coating 31 is located on a component 30 and wherein the thermal barrier coating 31 has a damaged region 32. In one embodiment, the method includes supplying a repair composition into the inlet opening 16, and depositing the repair composition from the at least one outlet opening 17 onto the damaged region 32 and concurrently traversing the squeegee apparatus 10 over the damaged region 32 while contacting a thermal barrier coating 31 adjacent to the damaged region 32 with the edge 40 of the lip member 15, wherein the extrusion face 14 is situated in front of the lip member 15 relative to a direction of the traversing of the squeegee apparatus 10 over the damaged region 32 (direction of the traversing shown in FIG. 7 with an arrow 50), whereby the repair composition is deposited onto the damaged region 32 to form a patch 33. In this embodiment, the length of the lip member 15 is greater than the maximal width of the damaged region 32. Thus, the lip member 15 maintains contact with the thermal barrier coating 32 on the edges of the damaged region 32 as the squeegee apparatus 10 traverses over the damaged region 32. The lip member 15 collects any excess repair composition deposited over the damaged region 32.

In one embodiment shown in FIG. 8, the method further includes, subsequent to the depositing of the repair composition, traversing the squeegee apparatus 10 over the patch 33 while contacting the patch 33 with the edge 40 of the lip member 15 (direction of the traversing shown in FIG. 8 with an arrow 51). This second pass with the squeegee apparatus is aimed at collecting with the lip member 15 any excess repair composition protruding from the surface of the patch 33. In this step, there is no depositing of the repair composition from the at least one outlet opening 17.

The lip member and any other part of the squeegee apparatus, including the entire squeegee apparatus, may be compliant (i.e., flexible) and made from rubber-like low durometer material with shore hardness of approximately 60-62 on the A scale. Alternatively, the main housing of the squeegee apparatus may be not flexible while the lip member is flexible. Thus, the lip member may be made from rubber-like low durometer material with shore hardness of approximately 60-62 on the A scale. The squeegee apparatus may be easily attached and removed from the adaptor for easy replacement. The removed used squeegee apparatus may be discarded or cleaned, for example, with a water-based cleaning solution.

The squeegee apparatus may be secured to an end-effector, wherein the end-effector is operable to control movement of the squeegee apparatus. The squeegee apparatus may be secured to the end-effector directly or indirectly, for example, via the adaptor. Such end-effector may be an articulating and/or telescoping arm. The end-effector may be operated manually or it may be secured to a repair device.

The squeegee apparatus may have a compact design intended to cover the maximal dimension of spallation area (i.e., damaged region) on damaged combustor liners. Typically, the maximal dimension of such damaged region is 50 mm. Minimizing the dimensions of the squeegee apparatus allows for a repair device to access a confined space and avoid collision with obstacles. A flow sensor may be installed inside of the adaptor to detect arrival of the repair composition at the squeegee apparatus. This also gives a feedback for coordination of repair composition flow with the motion of the end-effector during the repair process.

This written description uses examples to disclose embodiments of the invention, including the best mode, and also to enable any person skilled in the art to practice the invention, including making and using any devices or systems and performing any incorporated methods. The patentable scope of the invention is not limited to the scope of the provided examples, and may include other examples that occur to those skilled in the art. Such other examples are intended to be within the scope of the claims if they have structural elements or method steps that do not differ from the literal language of the claims, or if they include equivalent structural elements or method steps with insubstantial differences from the literal language of the claims.

EXAMPLES

Example 1

A specific embodiment of the squeegee apparatus of the invention is shown in FIGS. 9-13. In the embodiment shown in these figures, the lip member 15 has a length of 1.48 inches and an overall height of the squeegee apparatus 10 from the edge 40 to the inlet opening 16 is 1.40 inches. The entirety of the squeegee apparatus 10 depicted in FIGS. 9-13 is made from isobornyl acrylate. The following Table 1 provides material properties of this embodiment of the squeegee apparatus.

TABLE 1

| | ASTM | UNITS | METRIC | UNITS | IMPERIAL |
|---|---|---|---|---|---|
| Tensile strength | D-412 | MPa | 0.8-1.5 | Psi | 115-220 |
| Elongation at break | D-412 | % | 170-220 | % | 170-220 |
| Compressive set | D-395 | % | 4-5 | % | 4-5 |
| Shore Hardness (A) | D-2240 | Scale A | 26-28 | Scale A | 26-28 |
| Tensile Tear resistance | D-624 | Kg/cm | 2-4 | Lb/in | 18-22 |
| Polymerized density | ASTM D792 | $g/cm^3$ | 1.12-1.13 | | |

Other embodiments of the squeegee apparatus will differ from the embodiment of Example 1. For example, other embodiments of the squeegee apparatus may differ in materials used, shape, number and orientation of outlet openings, and dimensions. For example, the length of the lip member may be from 0.5 to 3.0 inches. Ranges for various properties of other embodiments of the squeegee apparatus of the invention are provided in Table 2.

| | ASTM | UNITS | METRIC |
|---|---|---|---|
| Tensile strength | D-412 | MPa | 0.8-5 |
| Elongation at break | D-412 | % | 45-220 |
| Compressive set | D-395 | % | 0.5-5 |
| Shore Hardness (A) | D-2240 | Scale A | 26-77 |
| Tensile Tear resistance | D-624 | Kg/cm | 2-12 |
| Polymerized density | ASTM D792 | $g/cm^3$ | 1.12-1.17 |

Throughout this application, various references are referred to. The disclosures of these publications in their entireties are hereby incorporated by reference as if written herein.

While only certain features of the invention have been illustrated and described herein, many modifications and changes will occur to those skilled in the art. It is, therefore, to be understood that the appended claims are intended to cover all such modifications and changes as falling within the true spirit of the invention.

What is claimed is:

1. A system comprising:

a squeegee apparatus which includes a main housing comprising an inlet end and an outlet end, the outlet end comprising an extrusion face and a protruding lip member, wherein the lip member is flexible and elongated, the inlet end comprising an inlet opening and the extrusion face comprising at least one outlet opening, wherein the inlet opening and the at least one outlet opening are in fluid communication with each other within the main housing, wherein the squeegee apparatus is configured to dispense and apply a thermal barrier coating;

a repair composition storage apparatus that stores the thermal barrier coating and is configured to deliver the thermal barrier coating to the squeegee apparatus; and a conduit through which the thermal barrier coating is delivered from the repair composition storage apparatus to the squeegee apparatus.

2. The system of claim 1, wherein the at least one outlet opening is a plurality of outlet openings, and wherein the squeegee apparatus comprises a material comprising a shore hardness within a range of 26 to 77 on a Shore A hardness scale.

3. The system of claim 1, wherein the extrusion face is elongated and positioned lengthwise adjacent to the lip member, and wherein the squeegee apparatus is composed of isobornyl acrylate.

4. The system of claim 1, wherein the extrusion face is elongated and positioned lengthwise adjacent to the lip member, and wherein the at least one outlet opening is a plurality of outlet openings.

5. The system of claim 4, wherein the main housing further comprises an internal chamber, wherein the internal chamber is in fluid communication with the inlet opening, and wherein the internal chamber is in fluid communication with the plurality of outlet openings via flow channels that are all parallel to each other and are located within the main housing.

6. The system of claim 1, wherein the inlet end is mounted to an adaptor, the adaptor further mounted to an outlet end of the conduit, and wherein the adaptor comprises a sensor operable to detect presence of the thermal barrier coating in the adaptor.

7. The system of claim 6, wherein the conduit further comprises an inlet end and wherein the inlet end of the conduit is mounted to the repair composition storage apparatus, and wherein the repair composition storage apparatus is operable to deliver the thermal barrier coating to the inlet opening via the conduit and the adaptor.

8. The system of claim 1, wherein the lip member has a straight edge.

9. The system of claim 1, wherein the lip member has a curved edge.

10. The system of claim 1, wherein the main housing comprises an inlet opening that is in fluid communication with one outlet opening located within the main housing via a single flow channel that extends from the inlet opening to the one outlet opening.

11. The system of claim 1, wherein the squeegee apparatus is composed of a heat resistant material comprising a polymerized density within a range of 1.12 g/cm$^3$ to 1.17 g/cm$^3$.

12. The system of claim 1, wherein the squeegee apparatus is composed of a material comprising a tensile strength between 0.8 MPa and 5.0 MPA.

13. The system of claim 11, wherein the squeegee apparatus is composed of isobornyl acrylate, wherein the lip member has a length between 0.5 inches and 3.0 inches, and wherein an overall height of the squeegee apparatus is between 1.3 inches and 1.5 inches.

14. The system of claim 13, wherein the lip member has a length between 1.4 inches and 1.6 inches, wherein an overall height of the squeegee apparatus is 1.4 inches, wherein the squeegee apparatus is composed of a material comprising an elongation at break from 45% to 220%, wherein the squeegee apparatus is composed of a material comprising a compressive set from 0.5% to 5.0%, wherein the squeegee apparatus is composed of a material comprising a shore hardness from 26 to 77 on a Shore A hardness scale, and wherein the squeegee apparatus is composed of a material comprising a tensile tear resistance from 2 Kg/cm to 12 Kg/cm.

15. A system turbine repair squeegee apparatus comprising:

a squeegee apparatus which includes a housing extending from an inlet end to an outlet end, the housing including a protruding, flexible, and elongated lip member along the outlet end, the housing including an inlet opening in the inlet end and outlet openings in the outlet end, the housing including an internal chamber and plural, parallel flow channels inside the housing that are all parallel to each other and that fluidly couple the inlet opening with the outlet openings, wherein the internal chamber, the flow channels, and the outlet openings are shaped to dispense a thermal barrier coating;

a repair composition storage apparatus that stores the thermal barrier coating and is configured to deliver the thermal barrier coating to the squeegee apparatus; and a conduit through which the thermal barrier coating is delivered from the repair composition storage apparatus to the squeegee apparatus.

16. The system of claim 15, wherein the inlet end is mounted to an adaptor, the adaptor further mounted to an outlet end of the conduit, and wherein the adaptor comprises a sensor operable to detect presence of the thermal barrier coating in the adaptor.

17. The system of claim 16, wherein the conduit further comprises an inlet end and wherein the inlet end of the conduit is mounted to the repair composition storage apparatus, and wherein the repair composition storage apparatus is operable to deliver the thermal barrier coating to the inlet opening via the conduit and the adaptor.

18. A system comprising:

a squeegee apparatus which includes a main housing comprising an inlet end and an outlet end, the outlet end comprising an extrusion face and a protruding lip member, wherein the lip member is flexible and elongated, the inlet end comprising an inlet opening and the extrusion face comprising an outlet opening, wherein the inlet opening and the outlet opening are in fluid communication with each other within the main housing via a single flow channel that extends from the inlet end to the outlet end, wherein the squeegee apparatus is configured to dispense and apply a thermal barrier coating;

a repair composition storage apparatus that stores the thermal barrier coating and is configured to deliver the thermal barrier coating to the squeegee apparatus; and a conduit through which the thermal barrier coating is delivered from the repair composition storage apparatus to the squeegee apparatus.

19. The system of claim 18, wherein the squeegee apparatus is composed of isobornyl acrylate, wherein the lip member has a length between 0.5 inches and 3.0 inches, and wherein an overall height of the squeegee apparatus is between 1.3 inches and 1.5 inches.

20. The system of claim 18, wherein the inlet end is mounted to an adaptor, the adaptor further mounted to an outlet end of the conduit, and wherein the adaptor comprises a sensor operable to detect presence of a repair composition in the adaptor.

* * * * *